US008813844B2

(12) United States Patent
Hopkins et al.

(10) Patent No.: US 8,813,844 B2
(45) Date of Patent: Aug. 26, 2014

(54) SYSTEM AND METHOD FOR DRILLING LATERAL BOREHOLES

(75) Inventors: Christopher Hopkins, Paris (FR); Niina Nobuyoshi, Cheltenham (GB); Stephen Bonner, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 743 days.

(21) Appl. No.: 12/745,633

(22) PCT Filed: Nov. 27, 2008

(86) PCT No.: PCT/EP2008/010153

§ 371 (c)(1),
(2), (4) Date: Dec. 14, 2010

(87) PCT Pub. No.: WO2009/068316

PCT Pub. Date: Jun. 4, 2009

(65) Prior Publication Data

US 2011/0278070 A1 Nov. 17, 2011

(30) Foreign Application Priority Data

Nov. 30, 2007 (EP) ..... 07122050

(51) Int. Cl.
*E21B 4/14* (2006.01)

(52) U.S. Cl.
USPC ..... 166/301; 166/178; 175/297; 175/299

(58) Field of Classification Search
USPC ..... 175/61, 62, 75, 78, 85
See application file for complete search history.

(56) References Cited

U.S. PATENT DOCUMENTS 4,402,551 A 9/1983 Wood et al.
4,497,381 A * 2/1985 Dickinson et al. ..... 175/61

(Continued)

FOREIGN PATENT DOCUMENTS

| | | |
|---|---|---|
| GB | 2247477 | 3/1992 |
| WO | 2004/072437 | 8/2004 |
| WO | 2005/010318 | 2/2005 |

OTHER PUBLICATIONS

T. Saito, et al., "Multi Functional Titanium Alloy "GUM METAL"," Materials Sciences Forum vols. 426-432 (2003,) pp. 681-688.

*Primary Examiner* — Cathleen Hutchins
(74) *Attorney, Agent, or Firm* — Stephanie Chi; Jody DeStefanis

(57) ABSTRACT

A drilling system for drilling a lateral borehole from a main borehole comprises a tubular conduit through which a fluid can be pumped, and a drilling assembly connected to the tubular conduit so as to receive fluid pumped therethrough. The drilling assembly comprises a power conversion unit, through which the fluid flows and which operates to provide a downhole power output; a drilling unit including a drilling apparatus powered by the output of the power conversion unit and operable to drill a lateral borehole into the formation surrounding the main borehole, and a liner unit for storing one or more liners for installation into the lateral borehole; and an anchor unit operable to anchor the drilling assembly in the main borehole when the drilling unit operates to drill the lateral borehole. A method of drilling a lateral borehole from a main borehole using such a drilling system comprises positioning the drilling assembly in the main borehole at a location of interest using the tubular conveyance; anchoring the drilling assembly in the main borehole using the anchor unit; operating the drilling unit to drill a lateral borehole from the main borehole; retrieving the drilling unit from the lateral borehole; releasing the anchor unit; and moving the drilling assembly to another location.

23 Claims, 9 Drawing Sheets

(56) References Cited

U.S. PATENT DOCUMENTS

| | | | | | |
|---|---|---|---|---|---|
| 4,640,362 | A | | 2/1987 | Schellstede | |
| 4,714,117 | A | | 12/1987 | Dech | |
| 4,787,465 | A | | 11/1988 | Dickinson, III et al. | |
| 5,074,366 | A | | 12/1991 | Karlsson et al. | |
| 5,163,521 | A | * | 11/1992 | Pustanyk et al. | 175/40 |
| 5,195,588 | A | | 3/1993 | Dave | |
| 5,388,648 | A | * | 2/1995 | Jordan, Jr. | 166/380 |
| 5,392,858 | A | | 2/1995 | Peters et al. | |
| 5,622,231 | A | * | 4/1997 | Thompson | 175/77 |
| 5,687,806 | A | | 11/1997 | Sallwasser et al. | |
| 5,692,565 | A | | 12/1997 | MacDougall et al. | |
| 5,715,891 | A | | 2/1998 | Graham | |
| 5,746,279 | A | | 5/1998 | Havlinek et al. | |
| 5,779,085 | A | | 7/1998 | Havlinek et al. | |
| 6,041,860 | A | | 3/2000 | Nazzal et al. | |
| 6,167,968 | B1 | | 1/2001 | Allarie et al. | |
| 6,220,372 | B1 | | 4/2001 | Cherry | |
| 6,260,623 | B1 | | 7/2001 | Schick | |
| 6,263,984 | B1 | | 7/2001 | Buckman | |
| 6,332,498 | B1 | | 12/2001 | George | |
| RE37,867 | E | | 10/2002 | Gondouin | |
| 6,648,068 | B2 | | 11/2003 | Dewey et al. | |
| 6,662,876 | B2 | | 12/2003 | Lauritzen | |
| 2002/0100588 | A1 | | 8/2002 | Murray et al. | |
| 2006/0137912 | A1 | | 6/2006 | Billingsley | |

* cited by examiner

SYSTEM AND METHOD FOR DRILLING LATERAL BOREHOLES

CROSS-REFERENCE TO RELATED APPLICATIONS

The present application is based on and claims priority to EP Application No. 07122050.3, filed 30 Nov. 2007; and International Patent Application No. PCT/EP2008/010153, filed 27 Nov. 2008. The entire contents of each are herein incorporated by reference.

TECHNICAL FIELD

This invention relates to systems and methods for drilling lateral boreholes from a main borehole. In particular, it relates to such systems and methods which use a flow of fluid along a tubular conduit to provide a power source for the various operations.

BACKGROUND ART

Lateral wells or drainholes are boreholes drilled out from a main well or borehole to improve communication with the formation. Conventional techniques for forming a lateral drainhole comprise the following multiple trips and steps:

Installation of Whipstock
Milling of casing window
Short-radius (a range between 6-18 m radius) drilling with a single or dual bent housing
Directional drilling
Deployment of a completion liner
Completion (more trips depending on drainhole conditions).

Multiple drainholes tied-in to a main cased or open well are expected to provide more effective oil recovery. However, a conventional drainhole construction in the manner described above requires costly and time-consuming operations, and it is also very difficult and complex in a thin hydrocarbon reservoir due to necessity of an entry curve from the main borehole to the lateral drainhole in the drilling trajectory. In unconsolidated formation, an entire length of the drainhole including both curved and straight portions may need to be cased and cemented with a completion liner to avoid collapse of the hole. This sort of completion requires multiple operations, sophisticated techniques and important costs according to nature of the drainhole. Various techniques have been proposed for systems and methods for forming drainholes or the like. These are discussed briefly below.

U.S. Pat. No. 6,167,968B1 and U.S. Pat. No. 5,392,858 disclose an apparatus for drilling holes in the steel casing of an oil or gas well, and drilling into the surrounding formations, including a number of components controlled by hydraulic fluid. This tool is available commercially under the trade name PeneDRILL by Penetrators Canada Inc. The tool is controlled and powered by fluid circulation from surface. It is capable to mill a 26 mm hole in the production casing and to drill a 17 mm hole in formation rock up to 2 meters in length. The tool contains two different drilling systems, one for metal casing and the other for formation rock. The tool is operable in the casing from 114 mm to 178 mm OD and is capable of four to eight tunnels per run.

The CHDT tool of Schlumberger comprises a downhole tool which uses a single drill bit and stem for casing milling and formation drilling. Further details are disclosed in U.S. Pat. No. 5,746,279, U.S. Pat. No. 5,692,565, U.S. Pat. No. 5,779,085 (and U.S. Pat. No. 5,195,588) and U.S. Pat. No. 5,687,806. The CHDT (Cased Hole Dynamics Tester) tool is a 108 mm diameter tool and is capable to drill a 7 mm diameter hole with 150 mm maximum penetration. The SCDT (Sidewall CoreDriller Tool), also of Schlumberger, is another similar tool with a 137 mm tool diameter. This tool cuts a cylindrical core with dimensions of 23 mm OD and 50 mm long from formation with up to 50 cores per trip. Neither the CHDT, SCDT or PeneDRILL tools are capable of installing liners or sealing them to casing in the main borehole.

U.S. Pat. No. 6,260,623 discloses an apparatus and a method for utilizing a flexible tubing string to form and isolate a lateral entrance opening to a lateral bore hole from a main borehole.

U.S. RE37,867E describes multiple operations and individual processes to complete a drainhole.

U.S. Pat. No. 5,074,366 describes a method and an apparatus for simultaneously drilling and casing a wellbore. The apparatus comprises an outer conduit string containing an inner drill string carrying a bit capable of drilling a wellbore with a greater diameter than the outer string. The drill string may be adapted to drill a nonlinear wellbore by offsetting the drill bit from the longitudinal axis of the outer string, and the drill bit is preferably retractable to permit withdrawal of the drill string after the wellbore completed, leaving the outer string of casing or liner in place.

U.S. Pat. No. 5,715,891 discloses a method for isolating each perforated or drainhole completion with the primary wellbore, for providing flow control means for each completion to permit selective testing simulation, production, or abandonment, and for facilitating selective re-entry into any cased drainhole for conducting additional drilling, completion, or remedial work.

U.S. Pat. No. 6,220,372 describes an apparatus for drilling lateral drainholes from a well casing with a flexible shaft having a bit at lower end to drill the drainholes in perpendicular to the main hole.

U.S. Pat. No. 6,263,984 describes a nozzle jet drill bits for drilling drainholes from a wellbore through a 114 mm or larger casing. U.S. Pat. No. 4,787,465 discloses a similar method and technique involving a hydraulic drilling apparatus and method suitable for use in a variety of applications including the drilling of deep holes for oil and gas wells and the drilling of vertical, horizontal or slanted holes, drilling through both consolidated and unconsolidated formations, and cutting and removing core samples.

U.S. Pat. No. 6,332,498 describes a completion method for drainholes. This invention includes a sleeve which can be positioned to give access to a window opening of the casing section in which the main casing is sealed from the liner section of a deviated wellbore to provide a hydraulic seal against passage of fluids from outside the casing of the wellbore into the main casing.

U.S. Pat. No. 6,648,068 describes a side tracking system including a window mill with a full-diameter cutting surface and a reduced diameter tapered cutting surface.

U.S. Pat. No. 6,662,876 describes an apparatus and a method for expanding tubulars in a wellbore.

U.S. Pat. No. 4,714,117 describes a method for completing a drainhole with casing, but without conventional cementing of the casing wherein in the drainhole portion of the wellbore a casing string composed of alternating casing subs and external casing packer subs is employed.

U.S. Pat. No. 4,402,551 describes a method and equipment to form horizontal cased and perforated drainholes for an underground, in-situ leach mining operation.

Lateral boreholes may need to be prevented from collapsing. Therefore, a completion liner has to be deployed and set. Slotted expandable liner (SEL) and solid expandable casing (SEC) are existing techniques for this function. SEL expansion is accomplished by opening up axial slots in the liner and by bending the steel (rather than deforming it). Unlike SEL, SEC expansion is achieved by yielding the pipe to a larger diameter, deforming it plastically. Similar to the slotted liner deployment, the solid expandable casing is typically expanded by moving an expansion mandrel through it. The expansion mandrel can either be mechanically pushed or pulled through the casing or hydraulically pumped. Both SEL and SEC are currently only available for boreholes of 114 mm diameter or above.

Most of the known systems are provided with electrical power via a wireline cable, for example the systems described in WO 2005/010318 and WO 2004/072437. However, this places a limitation on the power available for drilling and sealing. Also, most previous systems require the use of multiple tools for a complete drilling and completion operation.

This invention addresses these problems by using fluid flow as the power source and incorporating all functions in a single tool.

DISCLOSURE OF THE INVENTION

One aspect of this invention provides a drilling system for drilling a lateral borehole from a main borehole, comprising:

a) a tubular conduit through which a fluid can be pumped; and b) a drilling assembly connected to the tubular conduit so as to receive fluid pumped therethrough, the drilling assembly comprising:

i) a power conversion unit, though which the fluid flows and which operates to provide a downhole power output;

ii) a drilling unit including a drilling apparatus powered by the output of the power conversion unit and operable to drill a lateral borehole into the formation surrounding the main borehole, and a liner unit for storing one or more liners for installation into the lateral borehole; and iii) an anchor unit operable to anchor the drilling assembly in the main borehole when the drilling unit operates to drill the lateral borehole.

By using the power available from the fluid flow from the surface, it is possible for the drilling unit to have the ability to drill lateral boreholes of the desired dimensions and, where appropriate, install liners and seal the liners to casing in the main borehole. Also, all functional sections can be provided in a single tool.

Preferably the tubular conduit comprises drill string or coiled tubing.

In a particularly preferred embodiment, the power conversion unit operates to convert the flow of fluid from the conduit into electrical or hydraulic power.

The drilling unit can comprise a rotary drilling head including a drill bit and a power unit to provide torque, weight on bit and/or axial movement of the bit. The drilling unit can also include sensors for measuring torque, weight and/or displacement. The drilling unit typically comprises a weight on bit transmission system which comprises a driven drill stem, a fluid pressure drop across the bit or a fluid jet arrangement.

One embodiment of the drilling unit comprises a torque transfer system including a fluid-driven turbine for rotating the bit.

Alternative forms for the drilling apparatus include an abrasive water-jet drilling unit, a hammer drilling unit, an ultrasonic drilling unit, a rotating ultrasonic drilling unit or a laser drilling unit.

The drill can be string stored within the drilling unit and advanced from the drilling unit as drilling of the lateral borehole progresses. The drill string can also comprise the liner.

In one embodiment, the drill string is formed from at least one flexible or compliant element. In another, the drill string is stored in a segmented form in the drilling unit which is operable to join the drill string segments end to end to form the drill string.

The drilling unit can comprise either a single system for drilling (or milling) through both casing and the formation around the main borehole, or a first drilling sub-system for drilling though casing surrounding the main borehole; and a second, separate drilling sub-system for drilling into the formation surrounding the main borehole to form the lateral borehole.

In another embodiment, the liner unit is separate from the drilling apparatus and includes a separate liner that can be installed in the lateral borehole. The liner can be formed from at least one flexible or compliant element. It can also be stored in a segmented form in the drilling unit which is operable to join the liner segments end to end to form the liner.

In another preferred embodiment, the drilling assembly also comprises means to seal the liner to a casing in the main borehole after deployment. In one form, the means to seal the liner to the casing comprises a swage piece that is forced into contact with the liner to seal it to the casing, means to expand the liner into contact with the casing, or a shaped formation on the end of the liner that can be forced into sealing engagement with the casing.

A telemetry unit and/or a navigation unit can be included, if required, the telemetry unit allowing downhole data to be transmitted to the surface of the main borehole and by which commands from the surface of the main borehole can be sent to the drilling assembly; the navigation unit including a magnetometer, an inclinometer, a gyro sensor and/or a casing collar locator to assist in positioning the assembly in the main borehole.

Another aspect of the invention provides a method of drilling a lateral borehole from a main borehole using a drilling system as claimed in any preceding claim, comprising:

positioning the drilling assembly in the main borehole at a location of interest using the tubular conveyance;

anchoring the drilling assembly in the main borehole using the anchor unit;

operating the drilling unit to drill a lateral borehole from the main borehole;

retrieving the drilling unit from the lateral borehole;

releasing the anchor unit; and moving the drilling assembly to another location.

In cased boreholes, the method preferably further comprises:

deploying a liner in the lateral borehole; and sealing the liner to a casing in the main borehole.

The method according to the invention can be used for enhancing the productivity of an existing producing well, or for in situ sampling and or measurements of the formation around the well.

The systems and methods of the invention apply to both open hole and cased wells according to requirements.

Further embodiments and aspects of the invention will be apparent from the description below.

MODE(S) FOR CARRYING OUT THE INVENTION

This invention provides a drainhole construction and completion system, which can be capable of drilling a reasonably long lateral hole (25-38 mm diameter, 2-10 m long) perpendicular to the main well (which may be cased or open hole) and to placing a completion liner. Both drilling of the lateral hole and installation of the completion liner can be conducted with a single trip.

The present invention provides a system capable of three major operating functions:

(1) Lateral drilling:

(2) Deployment and installation of the completion liner; and (3) Sealing of the completion liner at casing.

Figure 1:
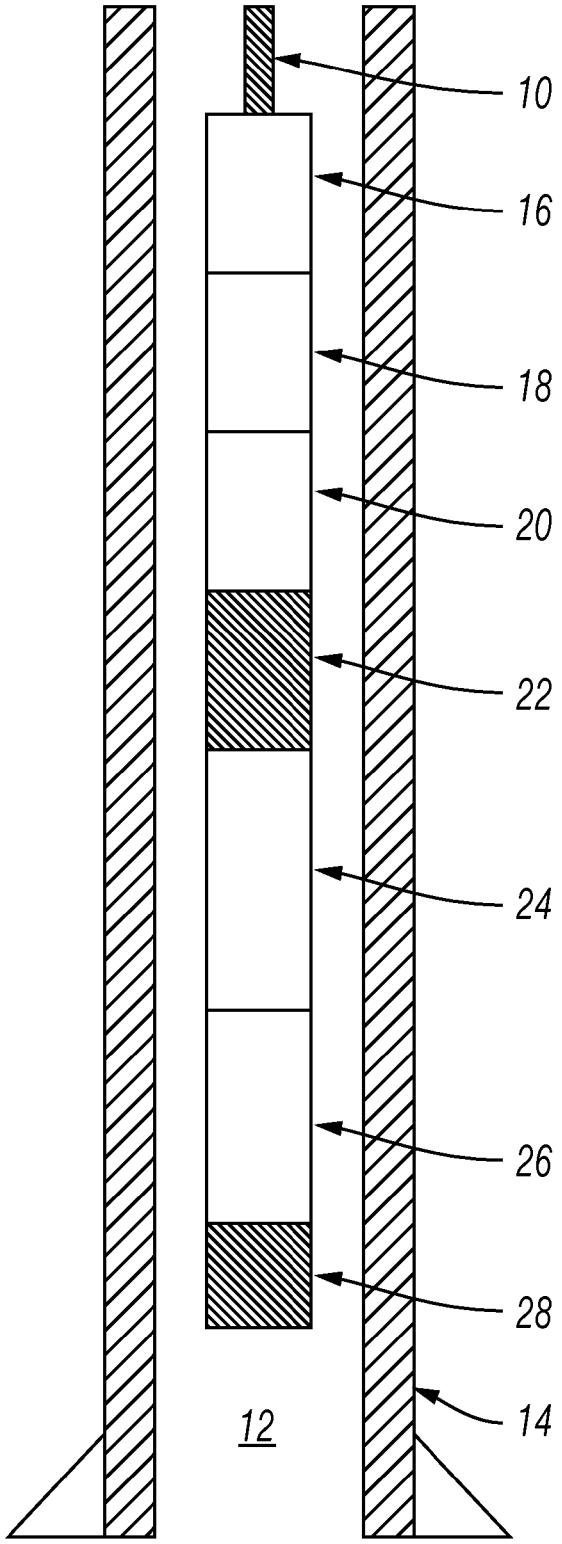
FIG. 1 shows a schematic view of a tool according to an embodiment of the invention in a cased borehole.

One embodiment of a system according to the invention comprises a downhole tool with seven different modules shown in FIG. 1.

A tubular conveyance 10, such as drill pipe or coiled tubing, is used to convey the tool inside a main borehole 12 lined with steel casing and cement 14 in the conventional manner. The tool comprises a power conversion module 16, a telemetry module 18, a navigation module 20, a drilling power module 22, a liner carrier module 24, a drilling and sensor module 26 and an anchoring module 28. The function of each module is described in more detail below.

The power conversion module 16 is used to convert fluid flow into a power source that is useable by the rest of the tool. Fluid is pumped from the surface through the drill pipes or CT 10 from the surface in the conventional manner. This flow is converted to electrical and/or hydraulic power in this section. The module includes a turbine that is driven by the fluid flow and is connected to a generator and/or a hydraulic pump. The flow of drilling fluid from the surface has the ability to provide substantially more power than would normally be available via wireline or a hydraulic line from the surface.

The telemetry module 18 allows downhole data to be transmitted to surface (Uplink) or surface commands to be sent to the downhole tool (Downlink). Where a wireline cable is present as well as the drill string or CT, a conventional wireline telemetry module can be used. Where no wireline is present, a 'mud pulse' telemetry system (such as are used in while drilling applications such as MWD and LWD), e.g. the PowerPulse and SlimPulse systems of Schlumberger, can be used to perform the equivalent function using a mud telemetry system.

The navigation module 20 includes navigation sensors such as magnetometers, inclinometers, gyros (such as are typically used for direction and inclination (D&I) modules in conventional downhole tools, whether for drilling or logging), and a casing collar locator (CCL) such as is commonly used in cased hole logging tools. These sensors provide the actual position of the tool in the well and allow the tool to be navigated to the desired depth and orientation accurately in the well 12. The data recorded by the navigation module are transmitted to the surface via the telemetry module where they are used to control positioning of the tool in the main borehole.

The drilling power module 22 is responsible for converting the electrical and/or hydraulic power output from the power conversion module 16 into an appropriate form for use in a drilling and controlling the application of this power. For example, a motor (e.g. an electric or hydraulic motor) can be arranged to provide a rotary mechanical output to deliver torque to a drill bit, axial actuators (e.g. hydraulic rams, worm drives, etc.) can be arranged to provide weight on bit and axial advancement of the bit. Monitoring sensors such as displacement sensors, torque sensors and weight sensors for drilling can also be provided to closely monitor the drainhole drilling process.

A long drill stem and completion liner or multiple drill stems and completion liners are stored in the liner carrier module 24 for deployment into the drainhole.

The drilling and sensor module 26 provides drilling mechanisms including torque, rotation, weight on bit, axial advancement, etc. This module can also include a protrusion piston to swage a completion liner at the casing 14 of the main borehole 12. Sensors, such as pressure sensors for monitoring reservoir pressures can also be provided in this module.

The anchor module 28 includes controllable anchor devices which are operable to lock the tool in place while drilling the drainhole.

The system of FIG. 1 can accomplish drainhole construction with a single trip. The major functional steps are:

(1) Conveyance of the new downhole apparatus at a desire depth and orientation with drill pipes or CT—Drilling of a drainhole through casing using power directly or indirectly generated from a fluid flow through the drill pipes or CT;

(2) Deployment of a completion liner while drilling or with a separate operation;

(3) Sealing and tying of the completion liner at the casing; and (4) Next target position.

Figure 19:
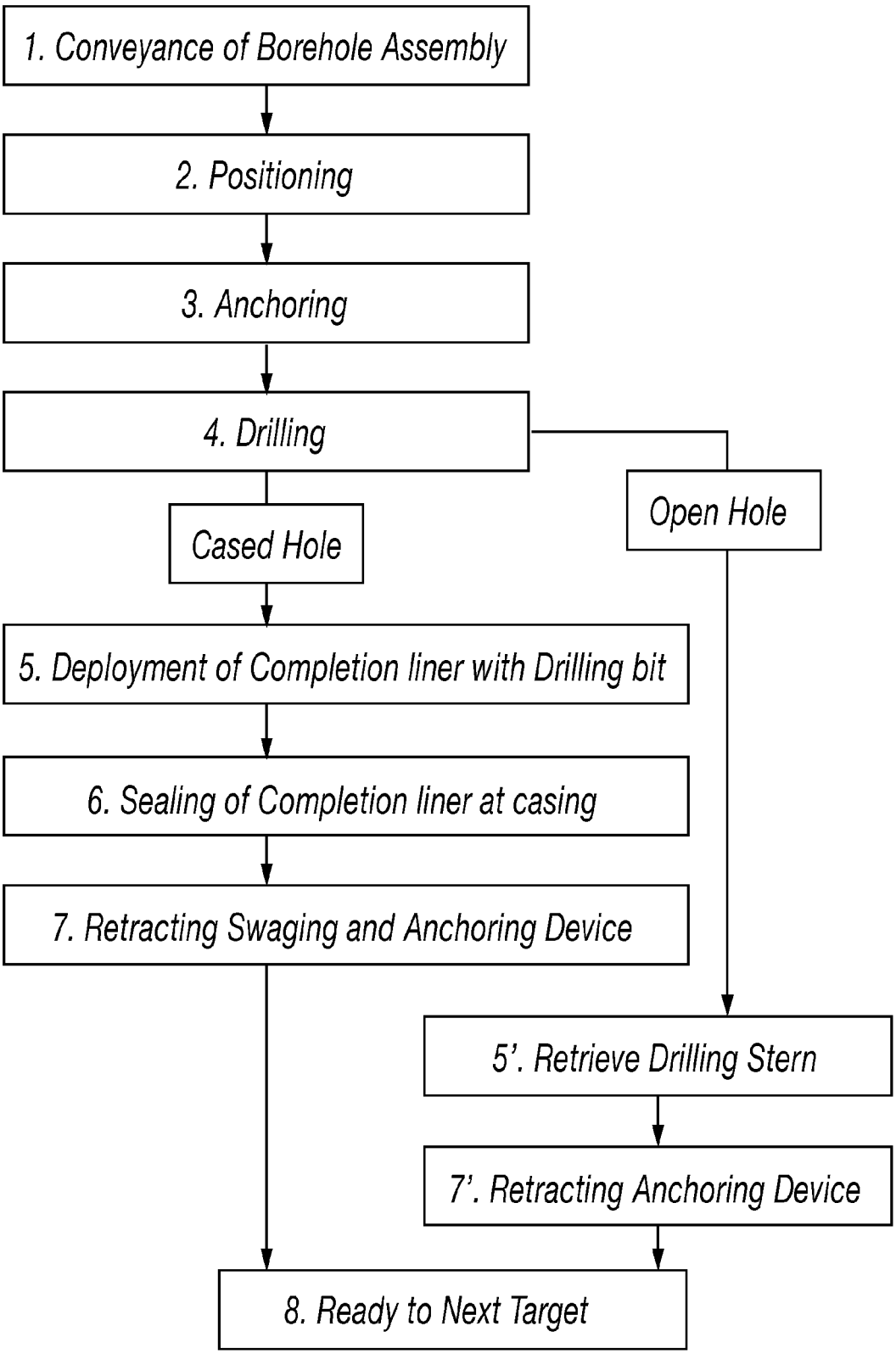
FIG. 19 shows a flow chart of the various steps of operation of the tool of FIG. 1.

Major operation processes of the system of FIG. 1 are discussed in more detail below. A flow chart detailing operation for cased and open hole operations is given in FIG. 19.

Operation Processes for Cased Hole

Step 1—Conveyance: The tool is conveyed to the location of interest by the tubular conveyance as is shown in FIG. 1.

Step 2—Positioning: Data from the navigation module sensors 20, such as, Accelerometers, Magnetometers but not limited to, Gyros, Casing Collar locators, are communicated via the telemetry module 18 to the surface and are used by the operator to position the tool at the correct depth in the main borehole 12 with the correct orientation to allow drilling in the correct direction.

Figure 2:
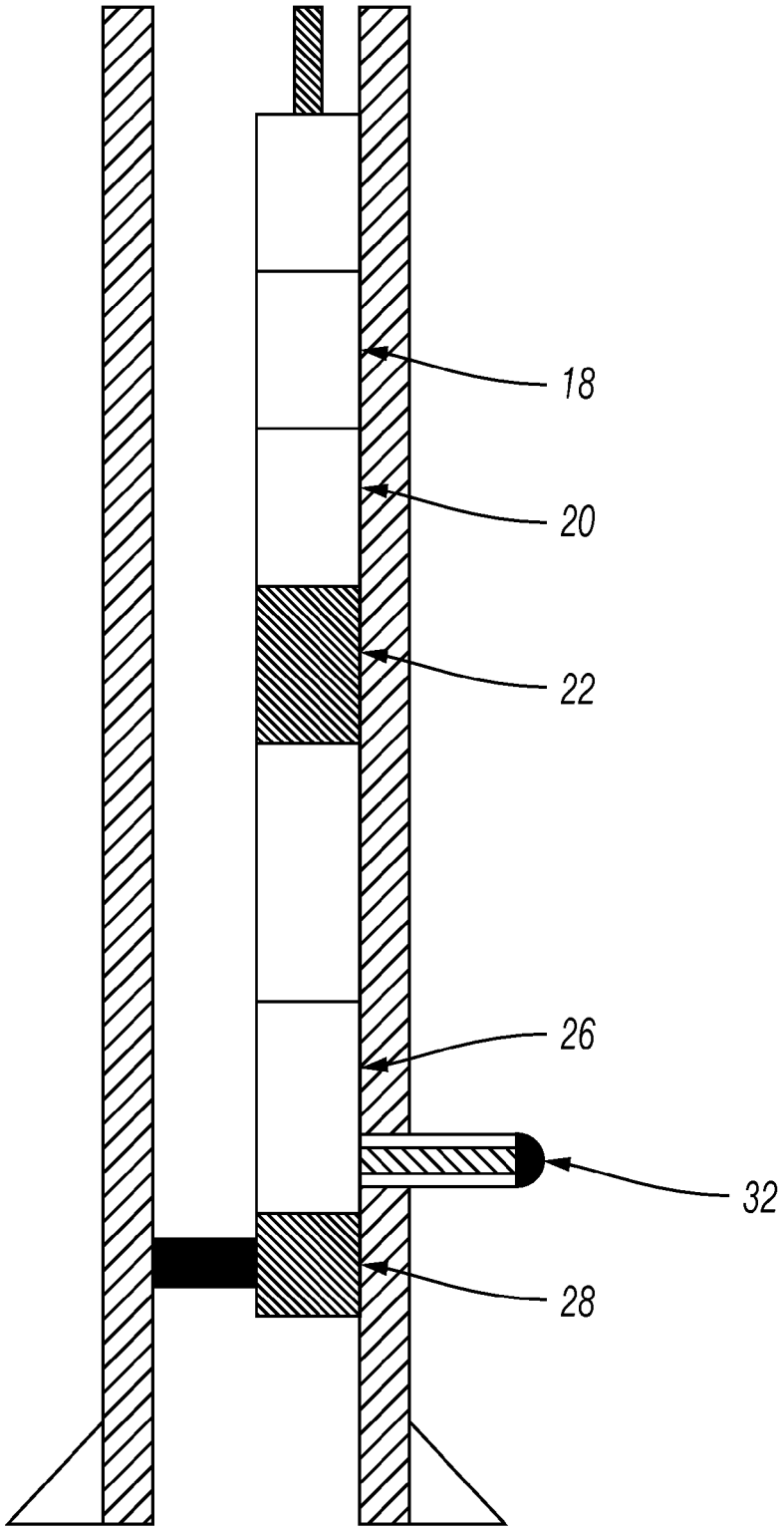
FIG. 2 shows the tool of FIG. 1 anchored in the casing and starting to drill.

Step 3—Anchoring: Once the tool is in position, the anchors 30 are deployed from the anchor module 28 to hold the tool in position in the casing 14 as is shown in FIG. 2.

Step 4—Drilling: Once the tool is anchored in position, the drilling mechanism 32 is deployed from the drilling and sensor module 26 to drill through the casing 14 and into the formation around the main borehole 12 (see FIG. 2). The preferred drilling mechanism comprises a rotary drilling technique in which torque, rotation and thrust force (WOB) needed for drilling are transmitted though a rotating drill stem to a drill bit.

Other drilling techniques that can be used include abrasive water jet drilling, hammer drilling, ultrasonic drilling, rotating ultrasonic drilling, etc. Laser drilling is a possible solution to drill (mill) a casing window and a drainhole consecutively.

Figure 3:
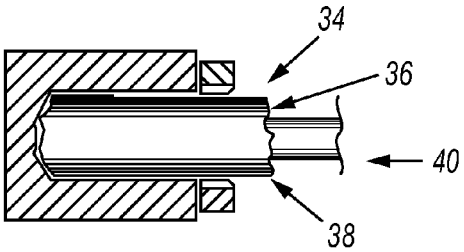
FIG. 3 shows an example of an ejector drilling system.

Instead of transmitting WOB through the drill stem, WOB can be created using different techniques. A system using a pressure drop across the drill bit is one other applicable method. FIG. 3 shows a suitable dual-tube system 34, which allows flowing a fluid through the annular space 36 between an outer and an inner tube 38, 40 and flushing debris through the inner tube 40 as is found in ejector drilling, would create a thrust force pushing the bit against a formation rock. This system has the advantage that WOB is created locally near the bit and so there is no risk of buckling of a long drill stem.

A system using a fluid jet technique is another potential WOB method. The fluid jet is ejected backwards (i.e. uphole) allowing propellant of the bit forward as well as lubricating the bit through nozzles. The circulation fluid is partially used to propel the bit and to create WOB.

While torque and rotation are typically provided at the drill bit by rotating the drill stem, other techniques are possible. For example, a hydraulic rotating motor like a turbine motor near the bit could generate sufficient rotation and torque to drive the bit during drilling. The axial flow of hydraulic fluid is converted to rotating motion with vanes, and the rotating motion is transmitted to the bit by a suitable mechanical transmission system. The similar technique is widely used in downhole tools converting from the fluid flow to electrical power through a turbine and alternator module.

If casing milling and formation rock drilling with the same bit are impossible, two different drilling bits and operations may be required to provide a milling system for the casing and the drilling system for formation rock.

Figure 4:
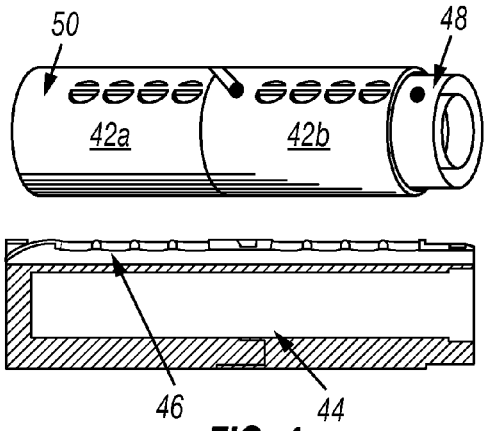
FIG. 4 shows a combined drill string and liner.
Figure 5:
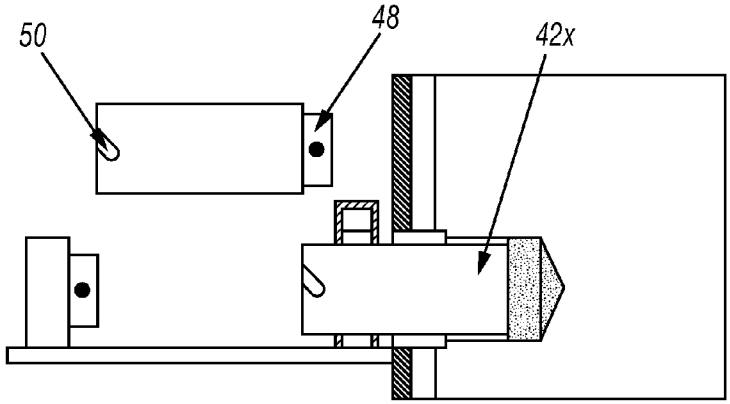
FIGS. 5-7 show steps of drilling with a segmented drill string.
Figure 6:
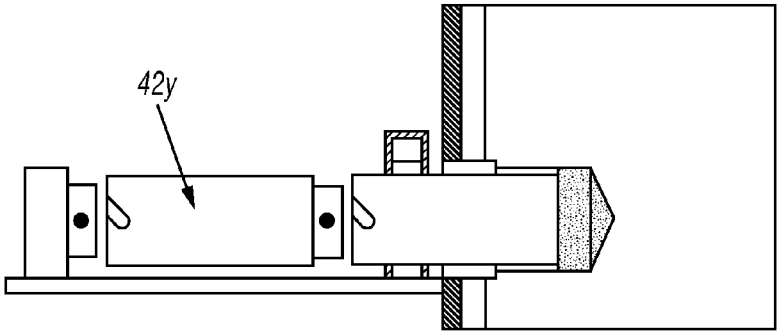
Figure 7:
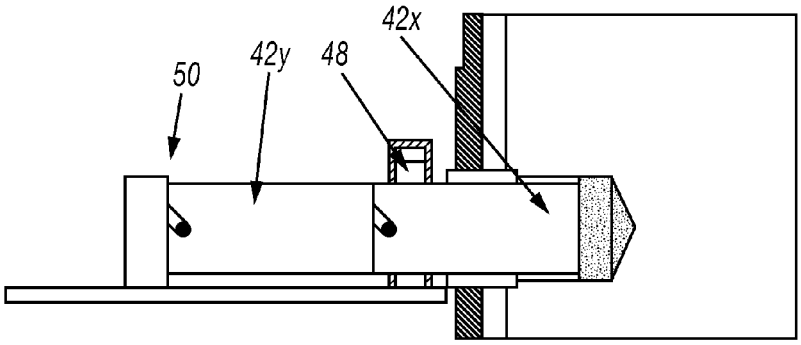

Step 5—Deployment of Liner: The most suitable method for deployment of a completion liner is while drilling rather than placing the liner in a separate operation. A segmented drill stem with the segments connected together in a chain-like arrangement can satisfy both the drill stem and completion liner functions. FIG. 4 shows one embodiment of a drill stem segment suitable for this use (a pair of connected segments are shown). The segment 42*a*, 42*b* has a double-tube structure comprising an inner tube 44 and an outer tube 46 and a quick-connect feature comprising pegs 48 at one end of a segment which engage in corresponding J-slots 50 in the adjacent end of the next segment. The segments are deployed horizontally one by one as is shown in FIG. 5-7. Torque and WOB are applied to the first segment 42*x* to drive the drill bit radially out of the tool 10 until the end of the segment 42*x* reaches the edge of the tool 10. At this point, the drive system is disengaged and withdrawn (FIG. 5). A second segment 42*y* is withdrawn from a storage cassette or the like and placed behind the first segment 42*x* (FIG. 6). The drive system then engages in the J-slots at the end of the second segment 42*y* and advances it to engage the first segment 42*x*, the pegs on the second segment engaging in the J-slots of the first segment 42*y* (FIG. 7). Thus torque and WOB can be applied to the drill bit via the two segments. As will be appreciated, this process can be repeated with multiple segments being connected to each other to build the single drill stem and completion liner. In this technique, it is not necessary to be able to direct the drill string around an ultra-short radius curve. The double-tube structure allows fluid circulation; the fluid flows through the inner tube 44 towards the drill bit and it returns through the annular space between the inner and outer tubes 44, 46.

Figure 9:
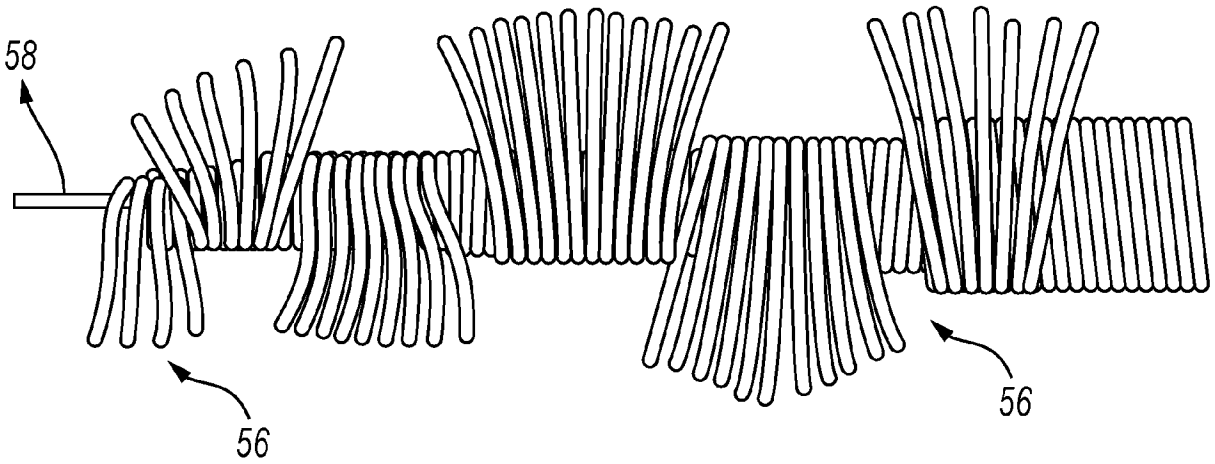
FIG. 9 shows an example of the construction of a flexible drill stem.
Figure 8:
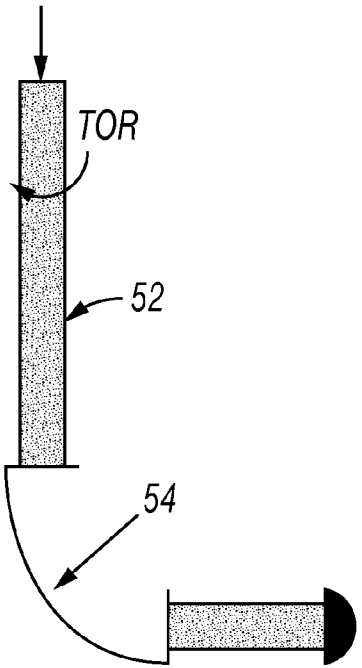
FIG. 8 shows an ultra-short radius drilling system.

Other embodiments of the invention may employ a single, flexible drill stem 52 to comply with an ultra-short radius formed by a kick-off guide 54 (see FIG. 8). Such a shaft must be able to transmit drilling power (TOR, WOB) as well as be able to flex. One such shaft flexible shaft is built several layers of wires 56 wound on a mandrel 58 (see FIG. 9). Such shafts are widely used to transmit rotary power along a curved path in equipment such as lawn trimmers, powered car seats, sun-roof drive mechanisms, robots, etc. The flexible drill stem can be built by winding the wires on a hollow mandrel, which allows a fluid flow. A flexible and pre-perforated completion liner with near hole-diameter can be deployed and placed in a separate operation.

Figure 11:
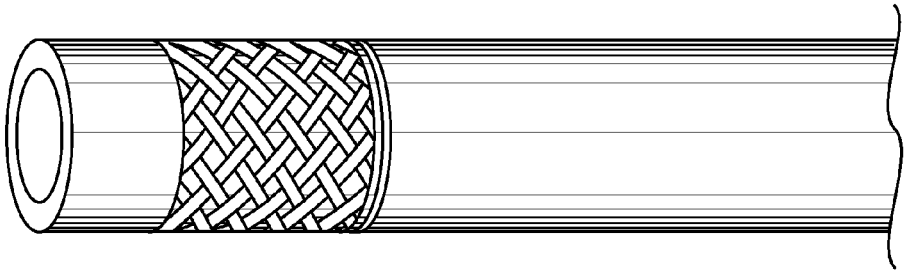
FIG. 11 shows a flexible drill shaft.
Figure 10:
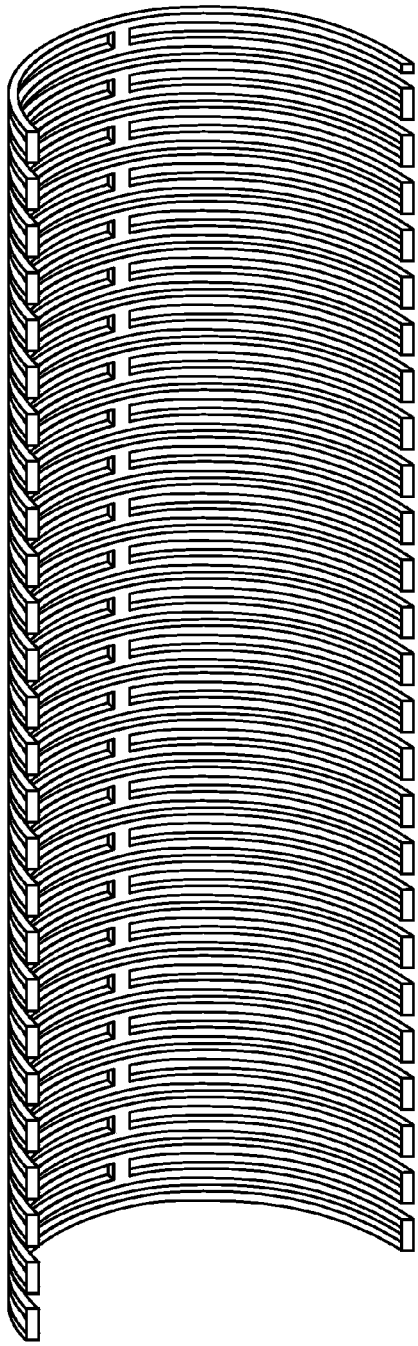
FIG. 10 shows a flexible slotted liner.

A compliant drill stem, which contains multiple universal joint functions is another option (for example, a drill stem of the type disclosed in WO 2004/113667). A suitable configuration has a double-tube structure similar to that of the segmented drill stem described above. The external tube has a number of circumferential slots and can behave as completion liner after drilling a hole (see FIG. 10). A conventional flexible tube would be used for the inner tube for the fluid circulation (see FIG. 11).

A composite liner or a metallic liner made of a super-elastic alloy (NiTi) or Gum metal (a beta-type titanium alloy with a body-centered-cubic structure—see for example, Takahashi, Saito et al, Multi Functional Titanium Alloy "GUM METAL", materials Sciences Forum Vols 426-432 (2003) pp. 681-688) can be applicable for the liner. The diameter of the liner should be slightly smaller than the drilled hole to facilitate deployment. An expandable and flexible completion liner using a technique of a self-propagating expandable screen, a pre-sprung screen, or an expandable screen is another option. The expandable liner is deployed with an expansion mandrel and it is activated or inflated by pulling or pushing the expansion mandrel mechanically.

Figure 12:
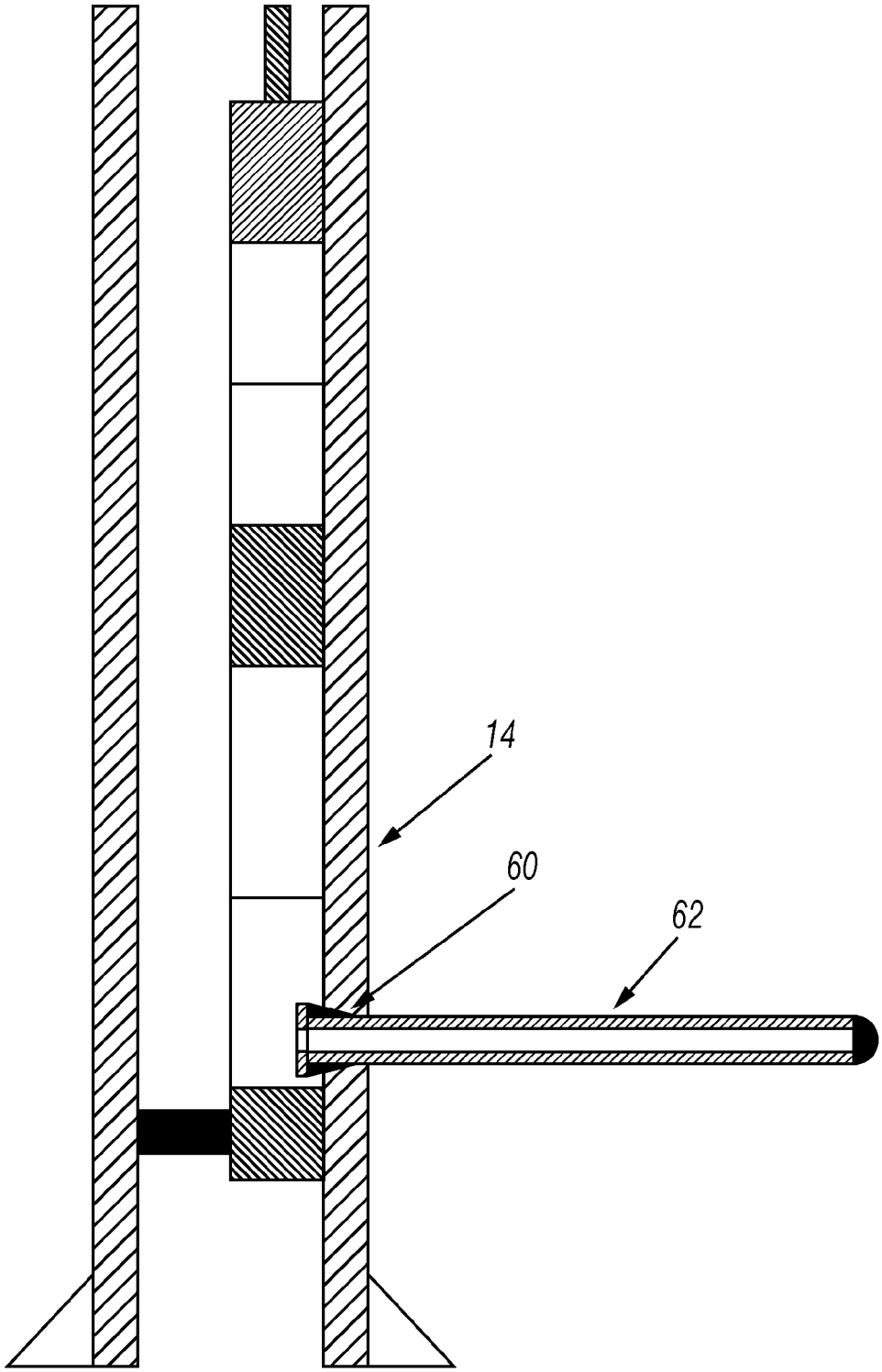
FIG. 12 shows the tool of FIG. 1 with a liner installed in the lateral borehole.
Figure 13:
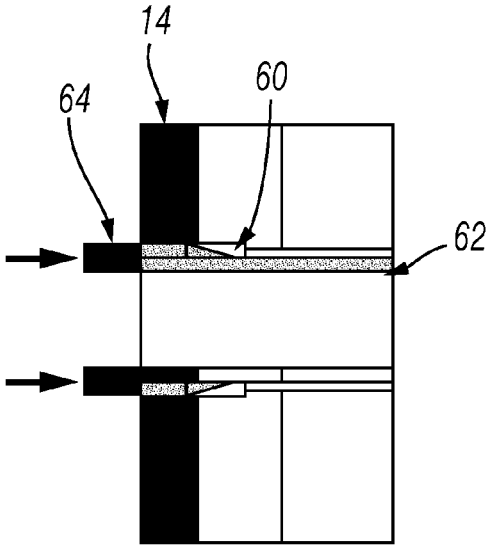
FIGS. 13-17 show various examples of sealing the liner to the casing.

Step 6—Sealing of Completion: Once the liner has been placed in the drainhole, it is necessary to seal it to the casing at the main borehole. The sealing technique used will depend in part on the liner design and deployment method. A mechanical swaging technique is one that may be particularly applicable for the segmented drill stem described above. After completing drilling, a hollow sealing piece 60 with a wedge shape at the end is pushed into a space between the casing 14 and the liner 62 (see FIGS. 12 and 13) with a swaging piston 64.

Figure 14:
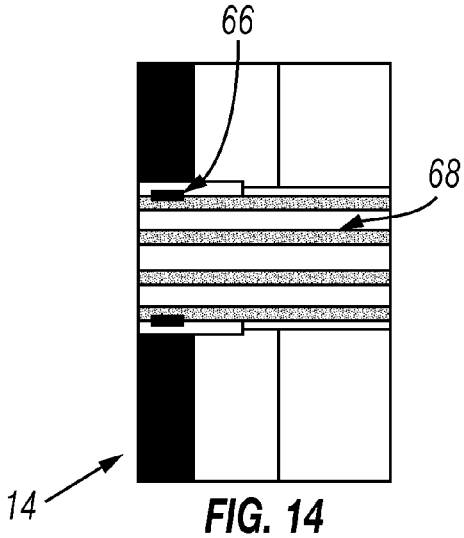
Figure 15:
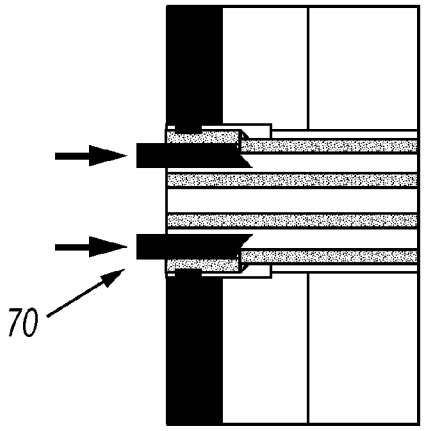

In an alternative embodiment, the last segment can be specially prepared to make a seal at casing 14. A ductile material such as a rubber or plastic ring 66 is mounted on the last segment 68 (see FIG. 14). A mandrel piston 70 pushes and expands a portion of the last segment intersecting the casing wall (similar to expansion of a conventional expandable tubular). The rubber or plastic ring on the segment is also expanded with the body, and seals at the casing 14 (see FIG. 15).

Figure 16:
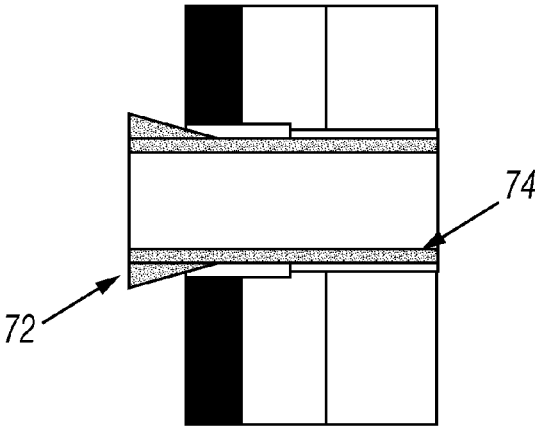
Figure 17:
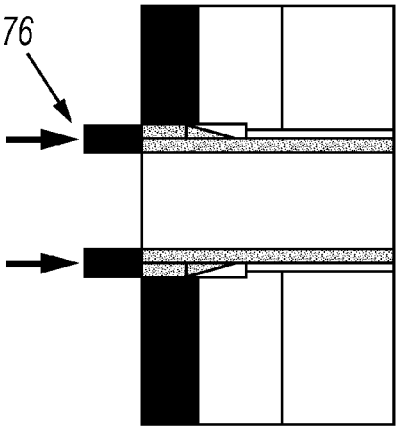

In a still further embodiment, a sealing feature can be integrated into the completion liner. A tapered and swaging feature 72 is provided at the end of the liner 74 (see FIG. 16). The feature 72 is pushed into the drainhole by a piston 76 and seals by permanently deforming the sealing feature 72 at the casing 14 (see FIG. 17).

A tapered and self-tapping feature can be integrated into the completion liner. In this case, the liner is simply pushed into the hole until the sealing feature reaches the casing. It is then pushed and rotated to tap into the casing (similar to a self-tapping pipe plug) and seals at the casing.

Figure 18:
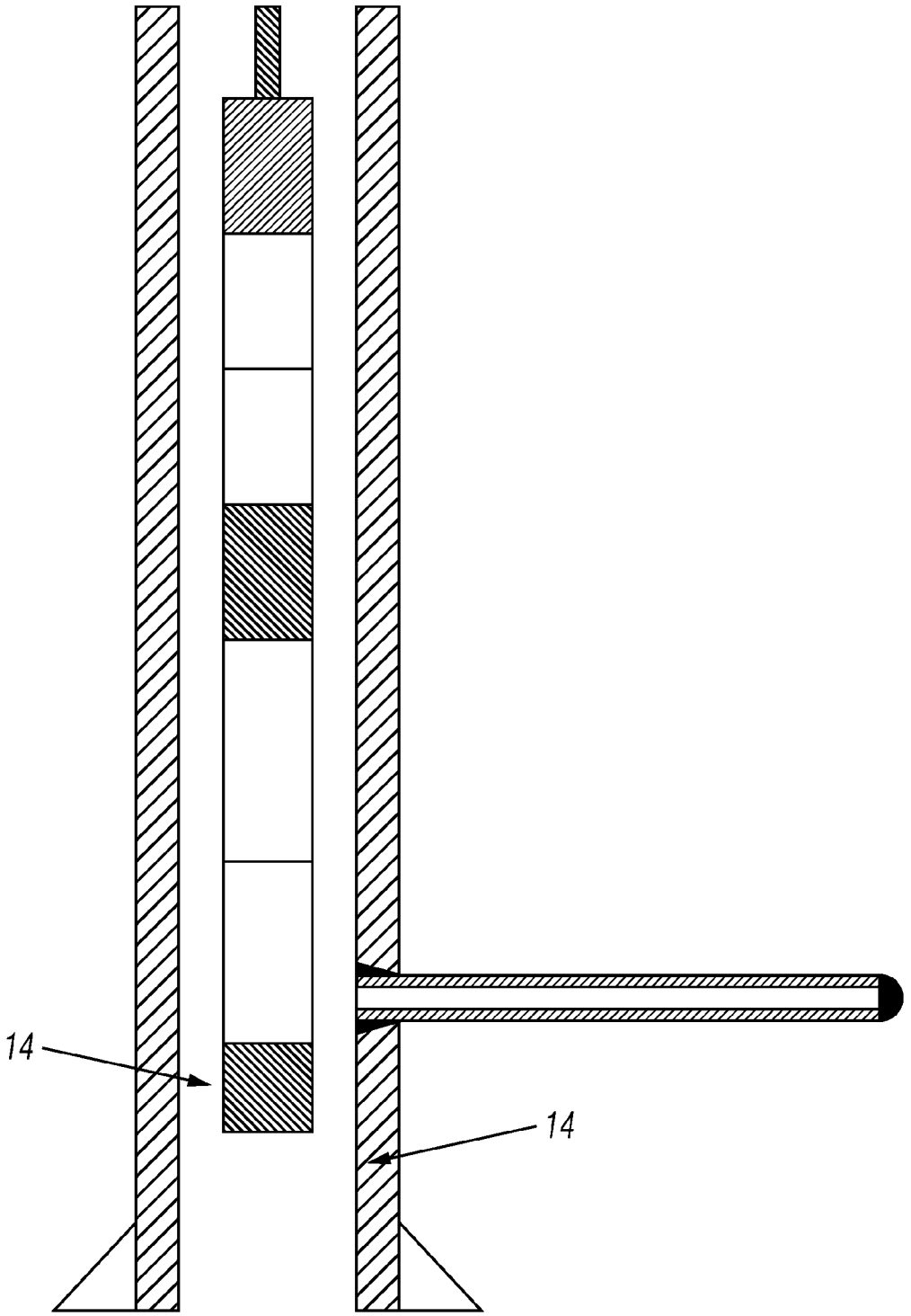
FIG. 18 shows the tool of FIG. 1 ready for movement to another location.

Step 7—Retracting swaging and anchoring devices: Any swaging tools used to seal the liner at the casing are pulled back, and the anchor devices are retracted to free the tool (see FIG. 18).

Step 8—Move to next location or orientation: Once the anchors are released, the tool is ready to move and or re-orient to the next target in essentially the same operation as Step 1 above.

Operational Processes for Open Hole

Steps 1-4 described above in relation to cased hole operation apply in open hole also.

Step 5'—Retrieve drill string: The drill stem is simply pulled back into the tool. Depending on applications and purposes, a completion liner may need to set in place. If so, similar operations described in the step 5 of Cased hole will be needed.

Step 6 is not performed in the open hole case and steps 7 and 8 are essentially the same as described above.

The embodiments described above represent only some of the possibilities of a system according to the invention. For example, ultrasonic drilling and rotating ultrasonic drilling, which has previously been used to machine very hard materials is possibly applicable in certain circumstances. In cases where EDM (Electrical Discharge Machining) cannot be applied due to electrically insulating hard materials, ultrasonic machining is a potential solution. Ultrasonic machining techniques can be an optional drilling method for hard and consolidated formations.

A critical problem in a deep hole drilling is buckling of the long drill stem, as is mentioned above. The traditional method used to avoid this is to use stabilizers and guides with an external diameter close to the hole diameter at various locations along the drill stem. However, the present invention may require a flexible and elastic drill stem to accommodate an ultra-short radius making the use of such solutions difficult. One of the alternative solutions is a 'self-propelled' drill bit. A water jet ejection technique or a differential pressure technique across the bit can create WOB near the drill bit.

Torque transmission through a long flexible drill stem can be undesirable. The use of local torque generation near the bit will eliminate this problem. Because the invention is based on the use of fluid flow to provide power, it is possible for this fluid flow to be converted to rotating motion (torque) near the bit by using a hydraulic actuator.

The present invention has a number of potential applications and would address three different areas:

1) Productivity enhancement and high recovery;
2) Effective and economical completion; and
3) In-situ measurements, sampling and control.

Productivity Enhancement and High Recovery

Minimization of pore pressure drop: A significant pore pressure drop from virgin reservoir to wellbore restricts productivity of oil. The pressure drawdown particularly occurs across skin close to the vicinity of wellbore, which is a zone of permeability impairment due to filtration of the drilling fluid. This is a potential issue for the oil recovery. The system described above can potentially address this issue by constructing a reasonably long lateral hole far exceeding the damaged zone, which will permit minimization the pore pressure drop and result in a more effective oil recovery.

Coning control: In the pay zone, the water level rises due to the production of oil, and water may encroach into the oil reservoir resulting in unproductive oil recovery. This water encroachment does not occur homogeneously and uniformly. It tends to progress adjacent to wellbore first. This problem can be more controllable by using two lateral completions, one in oil layer and the other in water layer, which the system according to the invention is capable of performing. This well structure can behave as in-situ water injection to enhance the oil productivity and to allow a broader rising water-front.

Oil recovery from a thin hydrocarbon reservoir: The existing drainhole drilling technique is difficult and risky for a thin hydrocarbon reservoirs because of the entry curve from the main well to the lateral drainhole in the drilling trajectory. The system according to the invention addresses this issue by drilling the drainhole substantially perpendicular to the main wellbore. The drilling plan can be very simple since there is essentially no entry curve in the drilling trajectory.

Clean and non-damaging perforating channels: The conventional explosive perforation technique has a risk of casing, cement or/and formation damage due to impaction of the very fast jet. A zone of the formation compaction, providing an additional skin, also appears adjacent to the perforated tunnels. The system according to the invention helps eliminate such risks and impairments since the hole is drilled while flushing cuttings and debris.

Effective and Economical Completion

Preventive treatment for sand-facing wells: Loose formation grains and fine particles such as clays may be produced along with oil, gas and water from unconsolidated reservoir when the induced dragging forces of the flow overcome the formation's restraining forces. There are already several passive-control to address this problem, such as but not limited to, a Sand screen and Proppant (gravel) packer.

The new tool would address this issue in a more active manner by constructing a high conductance conduit with the lateral completion (large and thick artificial fracture), avoiding the destructive pressure gradient near the wellbore resulting in lower dragging forces.

Pre-fracturing treatment in consolidated formation: Fracturing of the consolidated and hard formations is a challenge because of a stable high hoop stress and excess perforating friction pressures. Unbalancing and destabilization of the wellbore stress pattern could reduce the pressures at which fracturing occurs. Several lateral holes would break and unbalance the high hoop stress, leading to a more effective fracturing operation Elimination of Acidizing operation: Acidizing treatment is used to dissolve either the formation rock or materials, natural or induced, within the pore pressure spaces of the rock. It is also used to remove damaging materials induced by drilling or completion fluids or by production practice. However, strong chemicals are used in the acidizing services and their disposal is always problems. Sufficiently deep drainholes constructed by the new tool would exceed the contaminated and damaged zone and may eliminate costly and non-safety acidizing operations.

Effective and spatial fracturing: A rock has high permeability if oil, gas, or water can flow easily through existing channels and low permeability if the connecting channels are very small and fluid flow is restricted. In the case of high permeability, drilling fluids may enter the flow channels and later impair flow into the wellbore. In the case of low permeability, the flow channels may not permit enough flow into the wellbore. In either case, the well may not be commercial because fluid cannot flow into the wellbore fast enough. It then becomes necessary to create an artificial channel that will increase the ability of the reservoir rock to conduct fluid into the wellbore. Hydraulic fracturing can often create such channels. Artificial channels created from the large and deep drainholes constructed by the new tool would permit more effective and spatial fractures.

In-situ Measurements, Sampling and Control

In-situ measurements at remote place: Various measurements such as pressure and electrical resistivity can be carried out by installing appropriate sensors in the drainhole where it is isolated from the main wellbore. The measurements would not be disturbed by events in the main wellbore. A pore pressure measurement at the end of the drainhole would provide more accurate information to construct both a static reservoir model and a dynamic reservoir model while producing. It would also help understanding fluid movement within the reservoir and estimating vertical and horizontal permeability of the formation. An array of the resistivity sensors would be able to provide an alert of water coning and water movement in a timely manner.

Reservoir rocks saturated with hydrocarbons are complex. The complexity of both rock and fluid properties affects the quantity and distribution of fluids and the rate of flow of these fluids within the formation. The most certain way to know those properties is examination of formation geological samples (core samples) in the laboratory. There are two different techniques to acquire the core samples: drill-string coring (conventional coring); and wireline coring (side-wall coring). Both techniques have advantages and drawbacks. The side-core sampling function is feasible to implement into the system according to the invention. Side-cores from interesting zones identified by LWD measurements can be acquired while drilling. This technique addresses most of the drawbacks in the existing techniques.

Remote sampling: Formation sampling tools such as the MDT of Schlumberger need to spend a lot of time pumping out contaminated fluids before acquiring a clean sample from formation. Sampling from the end of a lateral drainhole far exceeding a damaged zone is more beneficial and saves much pump-out time since it is not as badly contaminated as normal sample locations. The remote sampling enabled by the present invention allows samples from interesting zones identified by LWD measurements to be acquired while drilling.

In-situ EOR in heavy oil: Heavy oil is always difficult to recover productively because of its high viscosity. One of the solutions to improve flow of the heavy oil is reduction of the viscosity by heating. The present invention permits the possibility of heater installation in the drainholes. Steam injection into the drainholes is an alternative solution. An in-situ thermal network by using the drainholes can facilitate the flow of the heavy oil, resulting in a better recovery and production.

The system according to the invention can overcome or improve problems and difficulties, which are encountered in the conventional drainhole construction in a number of ways, including:

- lower operation cost and time because of a single trip;
- better integrity of the main casing due to a localized window of small size;
- capability of multiple drainhole construction at the same depth (radial drainholes) due to small and non-radiussed construction;
- facilitation of a lateral drilling plan to reach a remote target since the new system is capable of drilling a hole perpendicular to the main wellbore;
- feasible to construct a drainhole in a very thin reservoir because of the perpendicular trajectory of the drainhole with respect to the main wellbore (no entrance curve);
- no additional conventional cementing operation since the completion liner can be cold-welded with the main casing; and
- predictable drainhole trajectory without the need for a sophisticated steering function.

Other changes within the scope of the invention will be apparent.

The invention claimed is:

1. A drilling system for drilling a lateral borehole from a main borehole comprising a casing, the drilling system comprising:

a) a tubular conduit through which a fluid can be pumped; and b) a drilling assembly connected to the tubular conduit so as to receive fluid pumped therethrough, the drilling assembly comprising:

i) a power conversion unit, through which the fluid flows and which operates to provide a downhole power output;

ii) a drilling unit including a drilling apparatus powered by the output of the power conversion unit and operable to drill a lateral borehole into the formation surrounding the main borehole, and a liner unit for storing one or more liners for installation into the lateral borehole; and iii) an anchor unit operable to anchor the drilling assembly in the main borehole when the drilling unit operates to drill the lateral borehole; and iv) a navigation unit comprising a magnetometer, inclinometer, gyro, and a casing collar locator for allowing the drilling assembly to be navigated to a selected depth and orientation; and v) a swage piece configured to seal a liner of the one or more liners to the casing when it is forced into contact with the liner, wherein the liner is sealed such that it remains with the casing in the borehole after the drilling system is removed from the borehole.

2. A drilling system as claimed in claim 1, wherein the tubular conduit comprises drill string or coiled tubing.

3. A drilling system as claimed in claim 1, wherein the power conversion unit operates to convert the flow of fluid from the conduit into electrical or hydraulic power.

4. A drilling system as claimed in claim 1, wherein the drilling unit comprises a rotary drilling head including a drill bit and a power unit to provide torque, weight on bit and/or axial movement of the bit.

5. A drilling system as claimed in claim 4, wherein the drilling unit includes sensors for measuring torque, weight and/or displacement.

6. A drilling system as claimed in claim 4, wherein the drilling unit comprises a weight on bit transmission system which comprises a driven drill stem, a fluid pressure drop across the bit or a fluid jet arrangement.

7. A drilling system as claimed in claim 4, wherein the drilling unit comprises a torque transfer system including a fluid-driven turbine for rotating the bit.

8. A drilling system as claimed in claim 1, wherein the drilling apparatus comprises an abrasive water-jet drilling unit, a hammer drilling unit, an ultrasonic drilling unit, a rotating ultrasonic drilling unit or a laser drilling unit.

9. A drilling system as claimed in claim 1, wherein the drilling unit comprises drill string stored within the drilling unit and capable of being advanced from the drilling unit as drilling of the lateral borehole progresses.

10. A drilling system as claimed in claim 9, wherein the drill string also comprises the liner.

11. A drilling system as claimed in claim 9, wherein the drill string is formed from at least one flexible element.

12. A drilling system as claims in claim 9, wherein the drill string is stored in a segmented form in the drilling unit which is operable to join the drill string segments end to end to form the drill string.

13. A drilling system as claimed in claim 1, wherein the drilling unit comprises a first drilling sub-system for drilling though casing surrounding the main borehole; and a second, separate drilling sub-system for drilling into the formation surrounding the main borehole to form the lateral borehole.

14. A drilling system as claimed in claim 1, wherein the liner unit is separate from the drilling apparatus and includes a separate liner that can be installed in the lateral borehole.

15. A drilling system as claimed in claim 14, wherein the liner is formed from at least one flexible element.

16. A drilling system as claimed in claim 1, wherein the drilling assembly also comprises means to seal the liner to a casing in the main borehole after deployment.

17. A drilling system as claimed in claim 16, wherein the means to seal the liner comprises means to expand the liner into contact with the casing.

18. A drilling system as claimed in claim 16, wherein the means to seal the liner comprises a shaped formation on the end of the liner that can be forced into sealing engagement with the casing.

19. A drilling system as claimed in claim 1, further comprising a telemetry unit.

20. A drilling system as claimed in claim 19, wherein the telemetry unit is configured to transmit downhole data to the surface of the main borehole and configured to transmit commands from the surface of the main borehole to the drilling assembly.

21. A method of drilling a lateral borehole from a main borehole using a drilling system, comprising:

positioning the drilling assembly in the main borehole at a location of interest using the tubular conveyance and using a navigation unit comprising a magnetometer, inclinometer, gyro, and a casing collar locator;

anchoring the drilling assembly in the main borehole using the anchor unit;

operating the drilling unit to drill a lateral borehole from the main borehole;

retrieving the drilling unit from the lateral borehole;

releasing the anchor unit; and moving the drilling assembly to another location;

deploying a liner into the lateral borehole; and sealing the liner to a casing in the main borehole using a swage of the drilling system, wherein the liner remains sealed to the casing after the drilling system is removed from the borehole.

22. A method as claimed in claim 21, for enhancing the production from an existing producing well.

23. A method as claimed in claim 21, for making in situ measurements and/or sampling from formations surrounding the main borehole.

* * * * *